US006612148B2

(12) United States Patent
Rich

(10) Patent No.: US 6,612,148 B2
(45) Date of Patent: Sep. 2, 2003

(54) PRESS HAVING TILT OUT FEATURE

(75) Inventor: Joseph William Rich, Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 30 days.

(21) Appl. No.: 10/007,791

(22) Filed: Dec. 3, 2001

(65) Prior Publication Data

US 2003/0101790 A1 Jun. 5, 2003

(51) Int. Cl.[7] ..... B21J 13/00; B30B 15/02

(52) U.S. Cl. ..... 72/448; 72/361; 72/421; 72/449; 100/218; 100/233

(58) Field of Search ..... 72/361, 427, 448, 72/449, 421, 453.16; 100/902, 218, 233

(56) References Cited

U.S. PATENT DOCUMENTS

| | | | | | |
|---|---|---|---|---|---|
| 530,162 | A | * | 12/1894 | Cuenot | 72/448 |
| 1,040,396 | A | * | 10/1912 | Paal | 100/218 |
| 3,885,466 | A | * | 5/1975 | Cerniglia | 100/218 |
| 3,942,431 | A | * | 3/1976 | Goff | 72/448 |
| 4,168,661 | A | | 9/1979 | Wigdahl | 100/218 |
| 4,413,499 | A | * | 11/1983 | Diemer et al. | 72/446 |
| 5,947,018 | A | | 9/1999 | Sloat et al. | 100/283 |
| 6,189,444 | B1 | | 2/2001 | Babiel et al. | 100/289 |

* cited by examiner

*Primary Examiner*—David Jones
(74) *Attorney, Agent, or Firm*—Margaret A. Dobrowitsky

(57) ABSTRACT

A mechanical press includes an easy load tilt out loading position that improves operator visibility when loading parts onto operation specific tooling, and which also increases the speed of which such parts can be loaded (and unloaded), and finally reduces the chance of operator error. The mechanical press includes a frame having a press head, a base pivotable between a load position and a working position, and a tie rod coupling the press head and the base. The press head is configured to reciprocate along a first longitudinal axis, responsive to an operator input such as pulling or rotating a handle. The press head and the base each include features configured to allow respective attachment of a first tool and a second tool, and whose specific configuration depends on the operation being performed by the press (i.e., shaping, assembly requiring pressure, etc.) The press head, when in the first position, is operative via the tie rod to place the base in the load position. The press head, when in a second position that is away from the first position and axially toward the base, is operative via the tie rod to place the base in the working position. The press head further includes a third position away from the second position and also axially nearer the base, is configured to actuate the first and second tools with respect to a workpiece so as to effect the operation. The press head includes a cylinder having a piston disposed therein configured to reciprocate along a second axis parallel to the first axis. The spring may be disposed in the cylinder, or outside around the tie rod end.

8 Claims, 2 Drawing Sheets

PRESS HAVING TILT OUT FEATURE

BACKGROUND OF THE INVENTION

1. Field of the Invention

The present invention relates generally to a mechanical press used in manual production processes to assemble a plurality of parts, and, more particularly, to a press having a tilt out feature to facilitate ease of loading such parts.

2. Description of the Background Art

Manually-operated mechanical presses are known generally in the art for use in a variety of assembly processes such as, for example, to shape a part, and/or putting together multiple parts that must be assembled using force.

One known type of mechanical press is a so-called rack-and-pinion type press. A rack-and-pinion press includes a frame having a base configured to receive operation specific tooling. The frame further carries a head unit configured for up and down movement by actuation of a hand lever coupled to the rack-and-pinion arrangement. The head unit on such a conventional mechanical press generally includes a mechanism for installing operation specific tooling on the head unit, which may be complementary with the operation specific tooling installed in the base. In such a conventional arrangement, the base slides out horizontally to a load position, wherein the operator loads the tooling with the parts to be assembled. The base (including the tooling now loaded with the parts) is then slid back in to a working position and locked down.

The above-described conventional approach, however, is characterized by poor visibility of the tooling from the point of view of the operator. That is, to load parts, and to ensure that the parts are loaded correctly, the operator must look straight down onto the tooling, which is difficult. The difficulties described above result in increased operator errors, and slower load and unload times.

U.S. Pat. No. 5,947,018 issued to Sloat et al entitled "MECHANICAL PRESS WITH CAM DRIVE" disclose a mechanical press that has a ram carried by a frame and movable to advanced and retracted positions by a ball screw assembly.

In view of the foregoing, there is therefore a need for an improved mechanical press that minimizes or eliminates one or more of the problems set forth above.

SUMMARY OF THE INVENTION

One object of the present invention is to provide a solution to one or more of the problems set forth above.

One advantage of the present invention is that it provides a part loading position where the tooling is tilted out to improve the visibility of the tooling to the operator, as well as easing the loading and unloading of the part(s). Another advantage of the present invention is that, due to the foregoing improvements, fewer operator errors are made, thereby improving the overall quality of the product. Still another advantage of the present invention is its flexibility, which allows for the use of any type tooling. Still another advantage is that the tilt out easy load feature requires less operator input and loads faster than any known alternative designs. Still yet another advantage is that the tilt out easy load feature allows for a very short press stroke. This, in turn, allows for the use of smaller, less costly presses and thus reduces non-value added motion.

According to the invention, a mechanical press is provided that includes a frame having a press head, a base, and a linkage member coupling the press head and the base. The press head is configured to reciprocate along a first longitudinal axis (e.g., up and down). The base is pivotable between a load position and a working position. The press head and the base each include features configured to allow respective attachment of a first tool and a second tool. The press head, when in a first position (e.g., start position) is operative via the linkage member to place the base in the load position. According to the invention, when in the load position, the main axis of the tool is tilted relative to the first longitudinal axis along which the press head moves, thereby providing improved visibility for the operator, as well as eased loading and unloading of workpieces. The press head, when in the second position that is moved away from the first position and is axially towards (i.e., closer to the base), is operative via the linkage member to place the base in the working position. The second tool associated with the base has a main axis associated therewith.

In a preferred embodiment, the linkage member comprises a tie-rod, and the press head includes a cylinder having a piston located therein, which is also configured to reciprocate along a second longitudinal axis that is substantially parallel to the first longitudinal axis. A first end of the tie rod is rotatably coupled to the piston, and the opposing end of the tie rod is rotatably coupled to the base. A spring is further included and is configured to operate in first and second phases such that (i) the first end of the tie rod moves with the motion of the press head between the first position (i.e., corresponding to a load position of the base) and the second position (i.e., corresponding to the working position of the base), and (ii) allows movement of the press head independent of the first end of the tie rod between the second position of the press head (i.e., corresponding to the working position of the base) and a third position moving toward the base. The first phase causes the base to pivot with the movement of the press head. The second phase allows the presswork to occur. Other features, objects; and advantages will become apparent to one of ordinary skill in the art from the following detailed description illustrating features of the invention by way of example, but not by way of limitation.

DETAILED DESCRIPTION OF THE PREFERRED EMBODIMENTS

Figure 1:
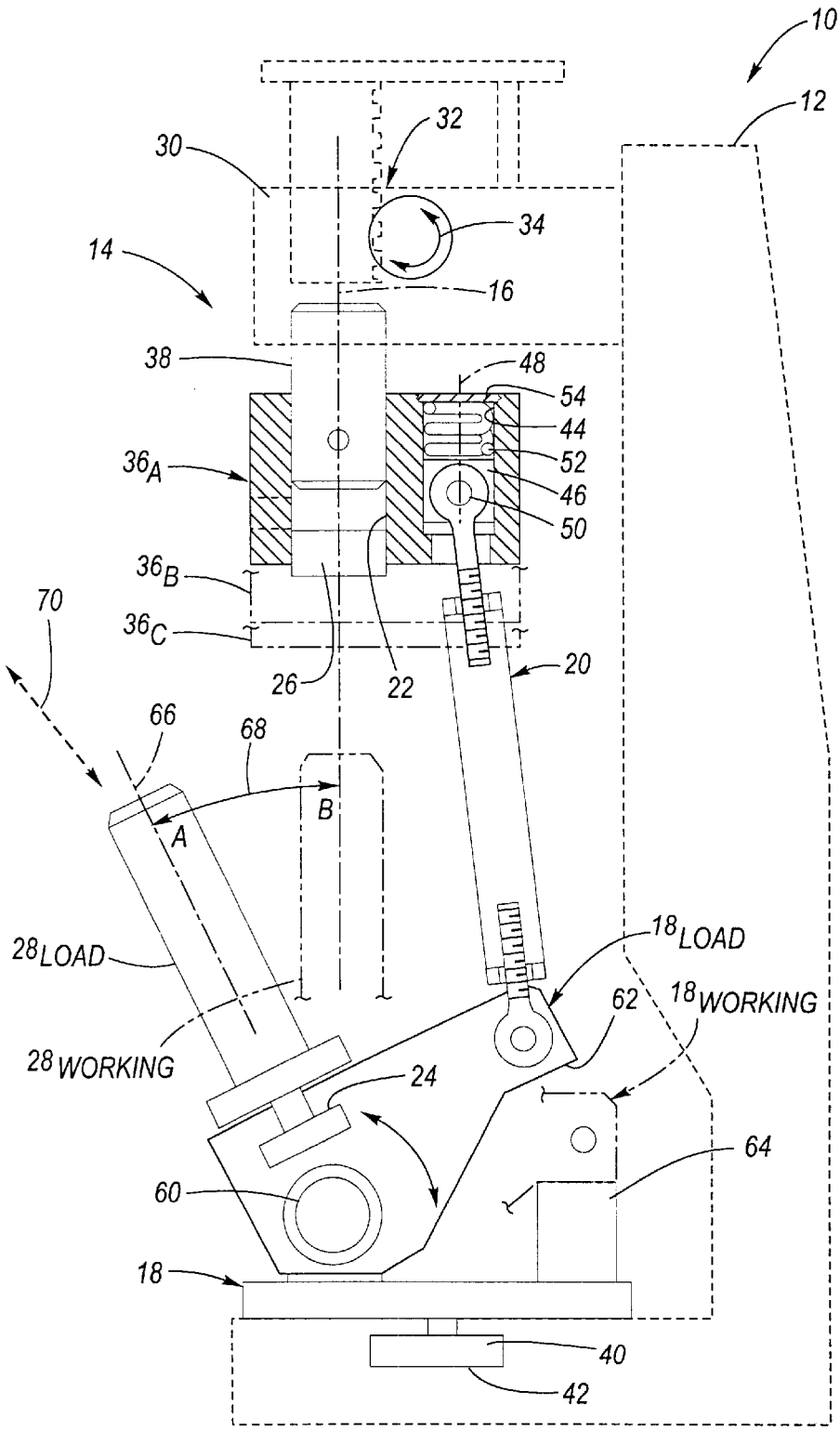
FIG. 1 is a simplified, side view of a first embodiment of the mechanical press according to the present invention.

Referring now to the figures wherein like reference numerals are used to identify identical components in the various views, FIG. 1 is a simplified side view of a mechanical press 10 according to the present invention. FIG. 1 shows a frame 12, a press head 14 configured to reciprocate along a first longitudinal axis 16, a base 18 pivotable between a load position (designated $\mathbf{18}_{LOAD}$) and a working position (designated $\mathbf{18}_{WORKING}$) and a linkage member, such as a tie rod 20, configured to couple press head 14 and base 18. As further shown in FIG. 1, press head 14 includes a feature 22 configured to allow attachment of a first tool 26, and base 18 includes a feature 24, such as a T-slot 24, configured to allow attachment of a second tool, designated 28.

In the illustrated embodiment, press 10 builds upon a conventional, and commercially available rack-and-pinion press such as, for example, model no. 3-6 SCHMIDT®

Rack-and-Pinion press, available from Schmidt Feintechnik Corporation, USA-Cranberry Township, Pa., USA. Thus, in the illustrated embodiment, the commercially available press includes frame 12, and original-equipment head unit 30 including a rack-and-pinion arrangement 32 that is capable of being actuated by way of, for example, a hand lever (not shown) rotating an input gear in the direction designated 34 in FIG. 1. Head unit 30 includes a feature to allow attachment of operation-specific tooling, and, according to the invention, a press head assembly 36 is attached to head unit 30 by way of a connecting member 38, in combination with fasteners, such as conventional set screws.

Thus, movement of head unit 30 is operative to move press head assembly 36 in a reciprocating fashion relative to longitudinal axis 16.

Likewise, the conventional press, referred to above, comes equipped with a feature, such as feature 40 (e.g., a T-slot) shown in FIG. 1, to allow attachment of operation-specific tooling. It should be understood, however, that although the embodiment of FIG. 1 is shown as being an extension of and improvement upon a commercially available and conventional rack-and-pinion mechanical press, that such an arrangement is not necessary for the present invention. In particular, it is specifically contemplated that an integrated design may be employed and remain within the spirit and scope of the present invention (i.e., integrate head unit 30, and press head assembly 36 into a single, integrated press head; and, integrate base 18 with the tool attachment surface of frame 12).

With continued reference to FIG. 1, press head assembly 36 includes a cylinder 44 having a piston 46 disposed therein configured to reciprocate along a second longitudinal axis 48 that is substantially parallel to the first longitudinal axis 16. A first end of tie-rod 20 is rotatably coupled to piston 46 by way of pivot 50. FIG. 1 further shows, in a first embodiment, a spring 52 located in cylinder 44, and retained in cylinder 44 by way of conventional means, such as cap 54 threadably engaging an inside diameter surface of cylinder 44.

The spring 52 provides the following functionality with respect to press head assembly 36 and base 18. Press head assembly 36 is shown in solid-line format in a first position 36A, and may be moved away from the first position to a second position that is axially toward (i.e., closer to) base 18, the second position being designated $\mathbf{36}_B$ (and shown in phantom-line format). The press head assembly 36 may be still further moved to a third position, designated $\mathbf{36}_C$, that is away from the second position $\mathbf{36}_B$, and is axially towards (or closer to) base 18. The spring 52 is configured to operate in a couple of phases such that (i) the first end of tie rod 20 that is connected to piston 46 moves with the press head assembly 36 between the first position $\mathbf{36}_A$ and the second position $\mathbf{36}_B$, and (ii) allows movement of the press head assembly 36 independent of the first end of the tie rod 20 between the second position $\mathbf{36}_B$ and the third position of the press head $\mathbf{36}_C$. The first phase causes the base to pivot with the movement of the press head. The second phase allows the presswork to occur.

Figure 2:
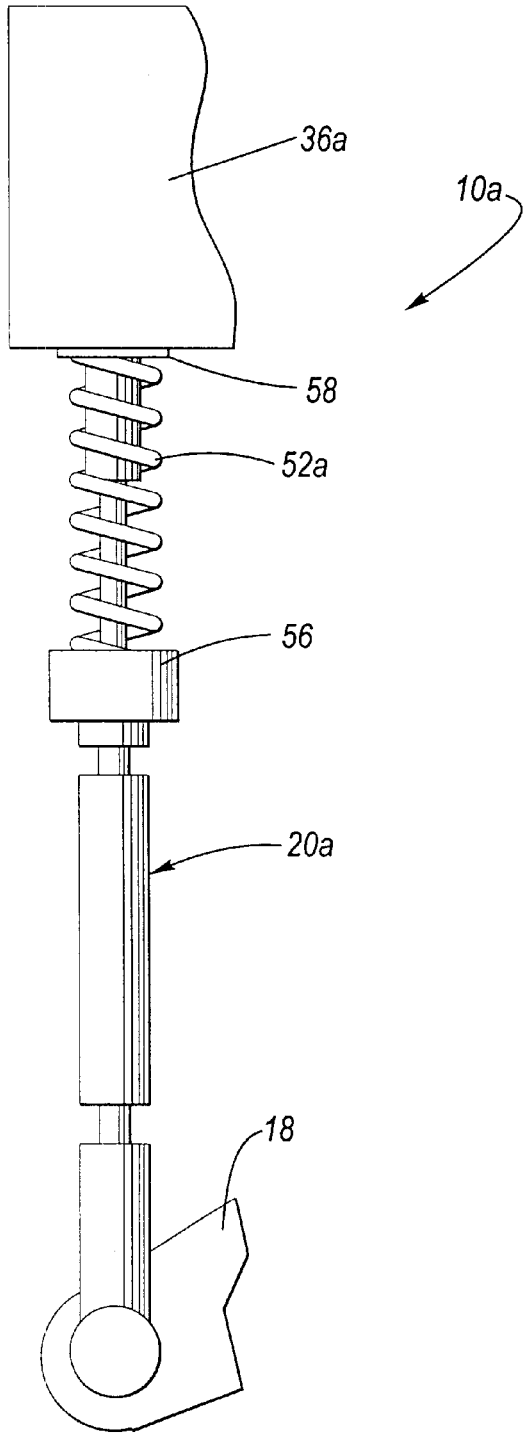
FIG. 2 is a simplified, partial side view of a second embodiment of the present invention, showing an alternative spring design.

FIG. 2 shows a second embodiment, designated generally 10*a*, in a partial, side view. Tie rod 20*a* has associated therewith spring bearing members 56, and 58, and between which spring 52*a* is located. Spring 52*a* performs the same functions as described for spring 52 shown in FIG. 1 but is located on the outside of tie rod 20.

With continued reference to FIG. 1, base 18 includes a main bearing or pivot 60, and a stop surface 62. Also shown in FIG. 1 is a stop block 64 coupled as part of base 18, but need not be so according to the invention. Operation-specific tooling 28 has a main axis 66 associated therewith.

In operation, press head assembly 36 assumes its uppermost, first position $\mathbf{36}_A$. The first position, by way of tie rod 20, places base 18 in its load position, designated $\mathbf{18}_{LOAD}$. In turn, the operation specific tooling 28 is in the load position, designated $\mathbf{28}_{LOAD}$. The initial, load position positions of the various referred-to components are all shown in solid-line format. In the load position, main axis 66 is tilted relative to first longitudinal axis 16 along which press head assembly 36 reciprocates. The tilt angle 68 provides for improved visibility for an operator inasmuch as an operator's line of sight, designated 70 in FIG. 1, is more closely parallel to the main axis 66 of the tooling 28. The invention is in contrast to the conventional art, wherein the tooling 28 would be brought out on a slide or the like and parts loaded onto the tooling. In such conventional arrangements, the operator's line of sight 70 can only be aligned with the main axis of the tooling 28, if at all, with great difficulty. The illustrated embodiment shows suitable tooling for the assembly of an automotive ignition coil; however, it should be understood that the application of the present invention may be made to a variety of fields of endeavor, limited only by the configuration of the tooling parts 26, and 28. As an example, the tooling may be used to fit component parts of a coil winding spool of an ignition coil.

Once the operator has loaded the parts on the tooling 28, the operator initiates the movement of the press head by actuating the racket pinion arrangement 32, for example, by pulling downward on a press handle (not shown) to rotate the gear in direction 34. As the press head 14, including press head assembly 36, moves axially toward base 18 along axis 16, tie rod 20 presses downward on base 18, causing the base 18 to rotate or pivot on bearing 60 until stop surface 62 abuts stop block 64. This places the base in a working position, designated $\mathbf{18}_{WORKING}$, shown in phantom-line format. The tooling 28 is also rotated into a working position, designated $\mathbf{28}_{WORKING}$. The working position of the base (and tooling 28) corresponds to a second position of press head 14, particularly press head assembly at the second position $\mathbf{36}_B$ (shown in phantom-line format). Further rotation by the operator in direction 34 causes further, axial movement of press head assembly 36 away from the second position $\mathbf{36}_B$ toward base 18, shown in exemplary fashion at a third position $\mathbf{36}_C$. At this point, such movement (i.e., movement past the second position $\mathbf{36}_B$) causes the piston 46 to begin to compress spring 52, and the presswork of the tools 28, and 26 relative to a workpiece commences. Generally, the force of the spring (i.e., more properly the force required to compress the spring) is selected so that the initial downward movement of press head assembly 36 will not compress the spring 52, but rather will cause the base 18 to be rotated downward to engage stop block 64. It is only after the stop surface 62 hits the stop block 64, that the force becomes sufficient to begin to compress the spring 52 allow movement of press head assembly 36 independent of the first end of the tie rod 20.

When the press head assembly 36 reaches the end of a stroke, the presswork is completed and the press head may be returned to its starting position $\mathbf{36}_A$. As the press head assembly 36 returns to its initial, first position $\mathbf{36}_A$, the tie rod 20 will move the base up to the load position $\mathbf{18}_{LOAD}$, inasmuch as the piston 46 will run out of travel at some point, thereby allowing for a direct upward pull via the tie rod 20.

The spring arrangement in FIG. 2 operates in essentially the same manner as the spring arrangement shown in FIG.

1. Initial downward movement of press head assembly 36*a* will directly couple via the tie rod 20*a* to move the base 18 away from its load position to its working position. However, once the base 18, particularly the stop surface 62 thereof, hits the stop block 64, further downward movement of press head assembly 36a will cause the spring 52*a* to be compressed, wherein the presswork of the workpieces is accomplished. It should be noted that in both embodiments, in the working position, main axis 66 is substantially congruent with main axis 16.

Additionally, the above-described commercially-available rack-and-pinion press, such as that offered from the Schmidt Company, provides the variety of error proofing features, such as features that ensure that the full stroke is performed before allowing a further cycle (i.e, a press return stroke lock will be activated and not allow the press head to return to its up position, and internally locks the parts in the press until a secondary operation is performed that satisfies the stroke length requirement). Such error proofing features can be retained in accordance with the present invention inasmuch as, in the illustrated embodiment, the various components are in the nature of an "add-on" to the commercially available press. It bears emphasizing, however, that such an "add-on" approach is not required for the present invention, which are limited only by the appended claims.

What is claimed is:

1. A mechanical press comprising:

a frame having a press head configured to reciprocate along a first longitudinal axis;

a base pivotable between a load position and a working position;

a linkage member coupling said press head and said base;

wherein said press head and said base each include features configured to allow respective attachment of a first tool and a second tool, said press head in a first position being operative via said linkage member to place said base in said load position, said press head in a second position away from said first position and axially toward said base being operative via said linkage member to place said base in said working position;

second wherein said press head further includes a third position away from said second position and axially toward said base configured to actuate said first and second tools with respect to a workpiece so as to effect an operation;

wherein said linkage member comprises a tie-rod;

wherein said press head includes a cylinder having a piston disposed therein configured to reciprocate along a second longitudinal axis parallel to said first longitudinal axis, a first end of said tie rod being rotatable coupled to said piston.

2. The press of claim 1, wherein said press head includes a rack and pinion arrangement for allowing said press head to reciprocate.

3. The press of claim 1, further comprising a spring configured such that (i) said first end of said tie rod moves with said press head between said first position and said second position of said press head and (ii) allows movement of said press head independent of said first end of said tie rod between said second position and said third position of said press head.

4. The press of claim 3, wherein said spring is located in said cylinder.

5. The press of claim 3, wherein said spring is located outside of said press head and disposed in relation to said tie rod so as to bear against said press head when said press head is moved to said second position.

6. The press of claim 1, wherein said tie rod includes a second end opposite said first end rotatably coupled to said base.

7. The press of claim 1, further including a stop block, said base including a stop surface configured to abut said stop block when said base is placed in said working position.

8. The press of claim 1, wherein said second tool includes a main axis, said main axis being tilted relative to said first longitudinal axis of said press head to thereby facilitate placement of said workpiece.

* * * * *